United States Patent [19]

Chi

[11] Patent Number: 4,971,640

[45] Date of Patent: Nov. 20, 1990

[54] COMPOSITE PROPELLANTS CONTAINING COPPER COMPOUNDS AS BALLISTIC MODIFIERS

[75] Inventor: Minn-Shong Chi, Newark, Del.

[73] Assignee: Thiokol Corporation, Ogden, Utah

[21] Appl. No.: 390,515

[22] Filed: Aug. 4, 1989

[51] Int. Cl.[5] ..... C06B 45/10
[52] U.S. Cl. ..... 149/19.9; 149/76
[58] Field of Search ..... 149/19.9, 76

[56] References Cited

U.S. PATENT DOCUMENTS

| | | | |
|---|---|---|---|
| 3,629,019 | 12/1971 | Lawrence | 149/19 |
| 3,876,477 | 4/1975 | Eldridge et al. | 149/19.3 |
| 4,202,714 | 5/1980 | Alley et al. | 149/109.4 |
| 4,243,444 | 1/1981 | Alley et al. | 149/18 |
| 4,263,071 | 4/1981 | Bain et al. | 149/19.9 |
| 4,315,785 | 2/1982 | Brodman et al. | 149/19.8 |
| 4,420,350 | 12/1983 | Camp et al. | 149/98 |
| 4,624,885 | 11/1986 | Mumford et al. | 428/222 |

OTHER PUBLICATIONS

Foster et al., *Low Exponent Technology*, AFRPL-TR-8-1-95, Feb. 1982, p. 58.

*Kirk-Othmer Encyclopedia of Chemical Technology*, 3rd edition, vol. 9, p. 622.

*CRC Handbook of Chemistry ad Physics*, 49th edition, Robert C. Weast, 1964, p. B-197.

*Primary Examiner*—Stephen J. Lechert, Jr.

*Attorney, Agent, or Firm*—George F. Wheeler; Allen H. Erickson

[57] ABSTRACT

A composite propellant composition consisting essentially of ammonium perchlorate as an oxidizer, a carboxy-terminated polybutadiene binder, ammonium sulfate as a cooling agent, and a small proporation of at least one copper compound which functions as a ballistic modifier to lower the pressure exponent of the propellant over a useful pressure range for combustion of the propellant in a gas generator or other device. The copper compounds also lower the $\pi_k$ value of the composition, particularly at pressures exceeding 3000 psi (about 2000 N/cm$^2$). Specifically exemplified copper compounds are copper chromite, copper phthalocyanine, and copper stearate.

18 Claims, 7 Drawing Sheets

COMPOSITE PROPELLANTS CONTAINING COPPER COMPOUNDS AS BALLISTIC MODIFIERS

Technical Field

The present invention relates to composite propellants which have a low combustion temperature, particularly propellants designed for use in gas generators.

Background Art

A gas generator rapidly generates gas under pressure by burning a propellant. Gas generators are used for inflating life rafts, automotive airbags, and other structures, for propelling rockets out of their canisters, and for other purposes.

Some relevant design criteria for gas generator propellants are as follows. First, the propellant combustion temperature must be low, for example below about 2000° F. (1100° C.), to avoid overheating the apparatus which is inflated or pressurized by the gas generator. Second, the burning rate of the propellant should not vary substantially with variations of pressure over the pressure range in which the gas generator will operate. The variation of burning rate with pressure is commonly expressed by a burning rate equation as follows: $r = ap^n$ wherein "r" represents the burning rate, "a" is a variable which depends on the initial grain temperature, "p" is the pressure in the combustion chamber, and "n" is the pressure exponent. It is very important that "n" be as close as possible to zero over the range of pressures for which the gas generator is designed. If "n" is positive, the burn rate will be unstable because a rise in pressure will increase the burn rate, which will in turn increase the pressure. If this positive feedback is substantial, the rocket will overpressurize and may explode. One problem in the art has been that if a gas generator having a relatively high operating pressure range is desired, it is difficult to provide a propellant which has a zero pressure exponent over the entire operating pressure range, including a safety margin above the intended operating pressure.

Another design criterion of gas generator propellants is that the combustion pressure should vary as little as possible with the temperature of the propellant composition just before combustion begins. The variation in burning pressure resulting from variations in initial propellant temperature is indicated by the parameter $\pi_k$. $\pi_k$ is calculated according to the following equation:

$$\pi_k = \frac{\ln(P_2/P_1)}{T_2 - T_1} \times 100\%$$

wherein P is pressure during combustion, T is temperature just prior to combustion, the subscript "1" indicates a first temperature and resulting pressure, and the subscript "2" indicates a second temperature and resulting pressure. A propellant with a small value of $\pi_k$ will provide consistent performance over a wider ambient temperature range than would a propellant with a larger value of $\pi_k$.

Ballistic modifiers are propellant ingredients which lower the pressure exponent of a propellant over a certain range of combustion pressures. Ideally, a ballistic modifier would make the pressure exponent zero at all pressures likely to be encountered in the combustion chamber, thus providing an absolutely constant burn rate. However, in the real world, a pressure exponent of zero can be approximated only over a fairly narrow range of operating pressures. Typically, above and below the pressure range in which the ballistic modifier operates, the pressure exponent is positive.

Furthermore, as the examples will show, the effect of a ballistic modifier in a particular formulation is frequently unpredictable. An ingredient which is an effective ballistic modifier with one binder, or one curing agent, or one distribution of oxidizer particle sizes, or in one proportion, may not be an effective ballistic modifier when these other parameters are changed. As the characteristic combustion temperature of a propellant is lowered substantially, the effect of the ballistic modifier can be changed or even eliminated in some cases. One side effect of excessive use of many ballistic modifiers is to decrease the burn rate of the propellant at all pressures, which is undesirable. Cooling agents often interfere with ballistic modifiers. Therefore, it is necessary to tailor a particular gas generator formulation by trial and error to provide the desired pressure exponent, $\pi_k$ profile, burning temperature, burning rate, and other properties simultaneously.

Copper phthalocyanine has the following molecular formula:

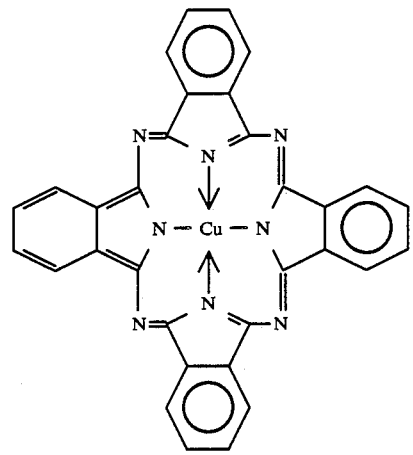

Copper phthalocyanine has been used before as a burning rate modifier, but not as a ballistic modifier Copper chromites, Which are mixtures of copper oxide and chromium oxide, and metal oxides have been used before as ballistic modifiers. See *Kirk-Othmer Encyclopedia of Chemical Technology,* Third edition, Volume 9, page 622. U.S. Pat. No. 3,629,019, issued to Lawrence on Dec. 21, 1971, discloses oxides of various metals, including iron, chromium, and copper, as burn rate catalysts. (Burn rate catalysts increase the burning rate of the composition.) In column 4, lines 48–70 of Lawrence, copper chromite is taught to increase the burning rate of the propellant. No effect on the pressure exponent of the propellant is mentioned in Lawrence. Different ratios of copper oxide and chromium oxide are illustrated by Lawrence at column 5, lines 5–20 in the table.

Two patents to Alley, et al., respectively U.S. Pat. Nos. 4,202,714, issued May 13, 1980, and 4,243,444, issued Jan. 6, 1981, each disclose the use of ballistic modifiers to impart a pressure exponent of about zero to a propellant over a wide pressure range and to reduce the temperature sensitivity of the propellant. Combinations of copper and lead chelates are proposed for this purpose, which is substantially similar to the purpose of the present invention. At column 1, lines 17–20 of Alley '714, cupric salicylate and lead beta-resorcylate are combined as a ballistic modifier. At column 2, lines 51–55, Table I and Table II of Alley '714 combinations of copper and lead chelates are used as burn rate modifiers. Of particular note is column 3, lines 53–55 of Alley '714, which states the following: "Based on past experience, the metal, lead, will probably be required for it to have ballistic activity." Thus, the reference does not disclose the utility of copper chelates in the absence of lead chelates as ballistic modifiers.

Gas generator case materials have improved, so higher combustion chamber pressures are obtainable. Thus, there is now a need for propellants which have low pressure exponents and low $\pi_k$ values at pressures exceeding 3500 psi (about 2400 N/cm$^2$). These improved properties are necessary so a gas generator can be designed to normally operate at a pressure of about 3000 psi (about 2000 N/cm$^2$) or more, with a useful margin of safety. Many ballistic modifiers of the prior art do not work in this range or do not provide a broad plateau or mesa of zero pressure exponent in this range.

Objects of the Invention

The objects of this invention are to achieve the following design criteria in a gas generator propellant:

A. a burn rate exponent of substantially zero on a mesa or plateau between about 2000 and about 3500 or more psi (about 1375–2400 or more N/cm$^2$) when other conditions of the propellant are optimized.

B. a $\pi_k$ value of 0.17%/°F. (0.30%/°C.) or less.

C. no substantial drop in burn rate due to the addition of a ballistic modifier to the propellant composition.

D. a flame temperature less than or equal to about 2000° F. (about 1100° C.).

A particularly desired objective is to obtain all these criteria simultaneously.

Summary of the Invention

The present inventor has discovered that a composite propellant consisting essentially of from about 20 to about 88% by weight ammonium perchlorate, from about 8 to about 40% by weight of a carboxy-terminated polybutadiene binder, from about three to about 20% by weight ammonium sulfate, and from about 0.1 to about 2% by weight of at least one copper compound has desirable and unexpected properties The present inventor has found that, in the context of the other ingredients mentioned above, a wide variety of copper compounds can function as ballistic modifiers.

The selection of a carboxy-terminated polybutadiene binder in a system which also contains ammonium sulfate as a cooling agent permits the copper compound to modify the ballistics of the composition desirably. If another binder is used, particularly hydroxy-terminated polybutadiene, the ballistic modifiers disclosed here do not work well in the presence of ammonium sulfate.

Compositions having the broad proportions defined above can readily be formulated to have $\pi_k$ values, pressure exponents, burning rates, and combustion temperatures within the ranges stated as objects of the invention.

Brief Description of Drawings

All the figures are log - log plots of pressure on the horizontal scale versus burning rate on the vertical scale. A horizontal plot segment, commonly referred to as a "mesa" or "plateau", has a burning rate exponent cf zero when so plotted. A sloped plot or plot segment indicates a positive or negative burn rate exponent, depending on whether it has positive or negative slope.

FIG. 7 also provides further evidence of the value of copper phthalocyanine as a ballistic modifier.

Detailed Description

Figure 1:
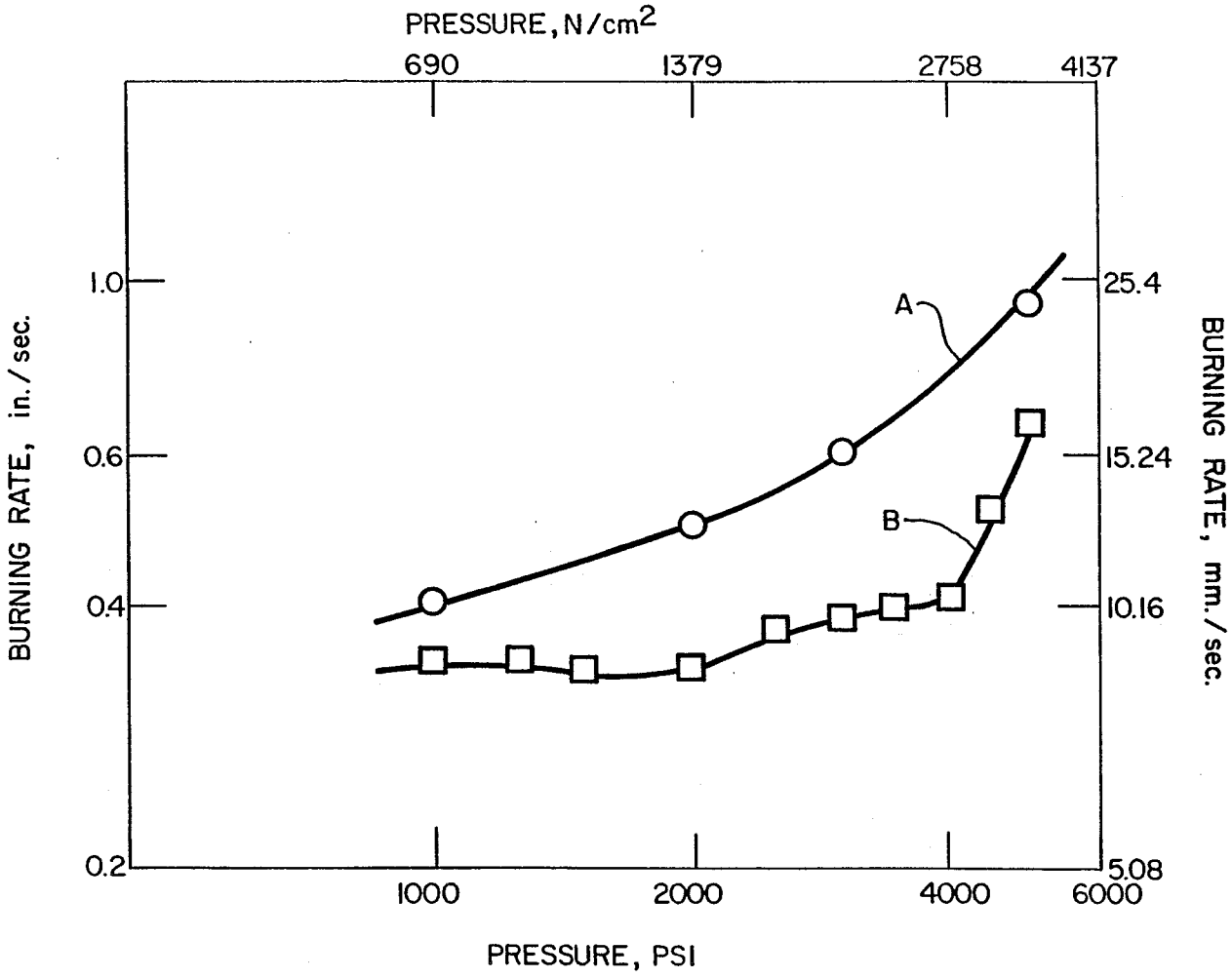
Fig. 1 PRIOR ART
FIG. 1 is a prior art plot illustrating the different effects of copper phthalocyanine on the ballistics of two hydroxy-terminated polybutadiene-bound propellants having different curing agents.

Propellants according lo the present invention have the basic formulation described above in the Summary of the Invention.

The first ingredient of the propellant is from 20 to about 88% by weight, preferably from about 50 to about 70% by weight, ammonium perchlorate. Ammonium perchlorate functions as an oxidizer in the propellant. It is contemplated that other oxidizers, such as ammonium nitrate or potassium nitrate, can also function herein. However, ammonium perchlorate is by far the preferred oxidizer unless special properties, such as reduced smoke generation, are necessary. Ammonium perchlorate is conventionally supplied as a mixture of feedstocks having different average particle sizes Under certain circumstances, illustrated in the examples and in FIG. 6, certain ratios of 90 micron and 18 micron particles, preferably a ratio of 70 parts of 90 micron particles and 30 parts of 18 micron particles, increase the range of pressures at which the pressure exponent is nearly zero. Ammonium perchlorate is typically the dominant ingredient in composite propellants. The other ingredients can be thought of as modifiers which provide desirable characteristics to ammonium perchlorate. Taken by itself, ammonium perchlorate has a burn rate exponent of about 0.4 to 0.5 over the range of from about 1000 to 3000 or more psi (from about 690 to about 2000 N/cm$^2$).

The second ingredient of the propellant contemplated herein is from about 8% to about 40% by weight, preferably from about 15% to about 30% by weight, of a carboxy-terminated polybutadiene binder. While other binders, particularly hydroxy-terminated polybutadiene, are more frequently used in propellant compositions, in the present system carboxy-terminated polybutadienes have been found to be superior binders because they do not interfere with the effect of copper compounds as ballistic modifiers. The general structure of carboxy-terminated polybutadienes is disclosed in U.S. Patent No. 4,624,885, issued to Mumford, et al., on Nov. 25, 1986. See in particular the text from column 3, line 48 to column 4, line 35, which describes chain-extended carboxy-terminated poly-1,2-butadienes useful herein. The organic peroxides and azo curing agents which are associated with carboxy-terminated polybutadienes are described from column 4, line 54 to column 5, line 13 of the same patent. The portions of U.S. Pat. No. 4,624,885 discussed above are hereby incorporated herein by reference. A particular carboxy-terminated polybutadiene useful herein is described in the examples.

The third principal component of the present propellant composition is from about 3% to about 20% by weight, preferably from about 8% to about 17% by weight, ammonium sulfate, which functions as a cooling agent. Ammonium sulfate is an interfering ingredient which prevents ballistic modifiers from operating in systems bound with hydroxy-terminated polybutadiene. The amount of ammonium sulfate used is regulated by the presence of other cooling ingredients and the degree of cooling desired. Other known cooling agents, such as DHG (dihydroxylglyoxime) and DAG (diaminoglyoxime) can also be used. The presence of substantial proportions of cooling agents distinguishes the present gas generator composition from rocket propellant compositions, which typically function at a much higher temperature.

The fourth essential ingredient of the present propellant compositions is from about 0.1% to about 2% of at least one copper compound. A first class of copper compounds contemplated herein is copper chelates. The Alley et al Patents previously cited, for example the '714 patent, column 2, lines 51–55 and Tables I and II, describe a variety of copper chelates. A preferred copper chelate for use herein is copper phthalocyanine. As mentioned before, copper phthalocyanine is known as a burn rate modifier. Burn rate suppression is not desired in the present propellants, so the amount of copper phthalocyanine used is preferably regulated so the burning rate is not substantially reduced by addition of this ingredient. In the case of copper phthalocyanine in the present system, the preferred proportions are from 0.5% to 2% by weight, most preferably from about 1% to about 1.5% by weight.

A second category of copper compounds useful herein is salts of fatty acids or lower alkyl carboxylic acids. The carboxylic acids contemplated herein are mono- or polyoarboxylic acids having from about 1 to about 22 carbon atoms. One particular such compound, the copper salt of stearic acid, has been found particularly useful herein About 0.5% to about 2% copper stearate is preferred for use herein.

A third category of copper compounds useful as ballistic modifiers herein is inorganic copper salts and salt mixtures containing the same. One particular compound contemplated herein is copper chromite. Although copper (I) chromite is assigned the exact formula $Cu_2Cr_2O_4$ in the *CRC Handbook of Chemistry and Physics*, 49th edition, 1968–1969, the copper chromite contemplated herein is a mixture having different proportions of copper oxide, $Cu_2O$, and chromium oxide, $Cr_2O_3$. U.S. Pat. No. 3,629,019, cited previously, in column 4, lines 48–70 and column 5, lines 5–20, shows different ratios of copper oxide and chromium oxide and the utility of the mixtures as a catalyst. The reference does not mention an effect on pressure exponent. The recited portions of the '019 patent are hereby incorporated herein by reference. The preferred proportions of copper chromite in the present system are from 0.5% to 0.7% by weight.

Since an inorganic copper compound, a simple aliphatic copper salt, and a complex copper chelate have each been found to act as a ballistic modifiers in the present propellant system, it is more broadly contemplated that any copper compound which is a source of copper in complexed or ionic form has utility as a ballistic modifier in the present system.

A wide variety of usual additional ingredients is contemplated for use herein. In the event a more energetic propellant is desired, from about 1% to about 20% by weight of a metal powder selected from aluminum, magnesium, boron, zinc, beryllium, mixtures thereof, and other metals commonly used as fuels in propellants is contemplated herein. Only minor proportions of such ingredients are preferred herein, however, to keep the flame temperature low.

Other modifying ingredients are also contemplated herein. Burn rate catalysts such as ferric oxide and chromium octoate can be used. Propellant bonding agents such as a propylene imine adduct of isophthalyl chloride are contemplated, for example. Other ballistic modifiers can also be combined with the copper compounds of the present invention. In one embodiment of the invention, lead compounds can be present as disclosed in the prior art, although another embodiment of the invention is essentially free of lead compounds. Any of the other known propellant ingredients are also useful herein, with the proviso that if a low temperature propellant is desired the proportions of highly energetic ingredients such as HMX, RDX, nitrate esters, and the like should be minimal.

Examples

The propellant compositions set forth in Tables 1, 2, and 3 below were prepared as follows. First, the propellant ingredients other than the curing agents (DDI or ERL-0510), cure catalysts (such as chromium octoate), and ammonium perchlorate were thoroughly mixed in a mixing bowl at 90° F. ± 5° F. (32° C. ± 3° C.). The ammonium perchlorate was added and mixed in four increments. These ingredients were mixed thoroughly for at least 35 minutes. Then the cure catalyst was added and mixed for 20 minutes.

For the compositions A-W of TabIe 1, the complete propellant was cast into a container and cut into strands. The burning rate and pressure plots of FIGS. 2–7 were generated by burning the strands.

Trials X - AC of Table 2 were carried out by casting each of the respective compositions into a four inch (10 cm) diameter by 12 inch (30 cm) long phenolic cylinder. The cylinder was removed, leaving a casting. The casting was cut into six four inch (10 cm) diameter, 2 inch high cylindrical grains. Each grain was machined to form a one pound (0.45 kg) grain of uniform size and shape, then potted into a test motor which was static fired.

The propellant of Table 3 was cast. Samples were taken from the casting, aged for the indicated time, and evaluated for mechanical properties.

FIG. 1 is taken from page 58 of Foster, et al., *Low Exponent Teohnology*, Report No AFRPL-TR-81-95 of the Air Force Rocket Propulsion Laboratory, Edwards Air Force Base, California, U.S.A (February, 1982). Plot A is for a formulation which contained 0.5% copper phthalocyanine and employed a hydroxy-terminated polybutadiene binder cured with isophorone diisocyanate — IPDI. The positive and steadily increasing slope of the curve indicates a positive pressure exponent, which is undesirable. Plot B is for a similar composition which also contained 0.5% copper phthalocyanine, but used DDI as a curing agent. Plot B is close to horizontal in the range between about 600 psi (414 N/cm$^2$) and 2000 psi (1379 N/cm$^2$), shows a substantially greater but still moderate pressure exponent between 2000 and 4000 psi (1379 to 2758 N/cm$^2$), and shows a sharp break or increase in the pressure exponent above 4000 psi. This illustrates the unpredictability of the value of copper phthalocyanine as a ballistic modifier if other ingredients of the composition are changed. It should also be noted that the propellants characterized in FIG. 1 are rocket propellants which do not contain ammonium sulfate or other cooling agents.

Figure 2:
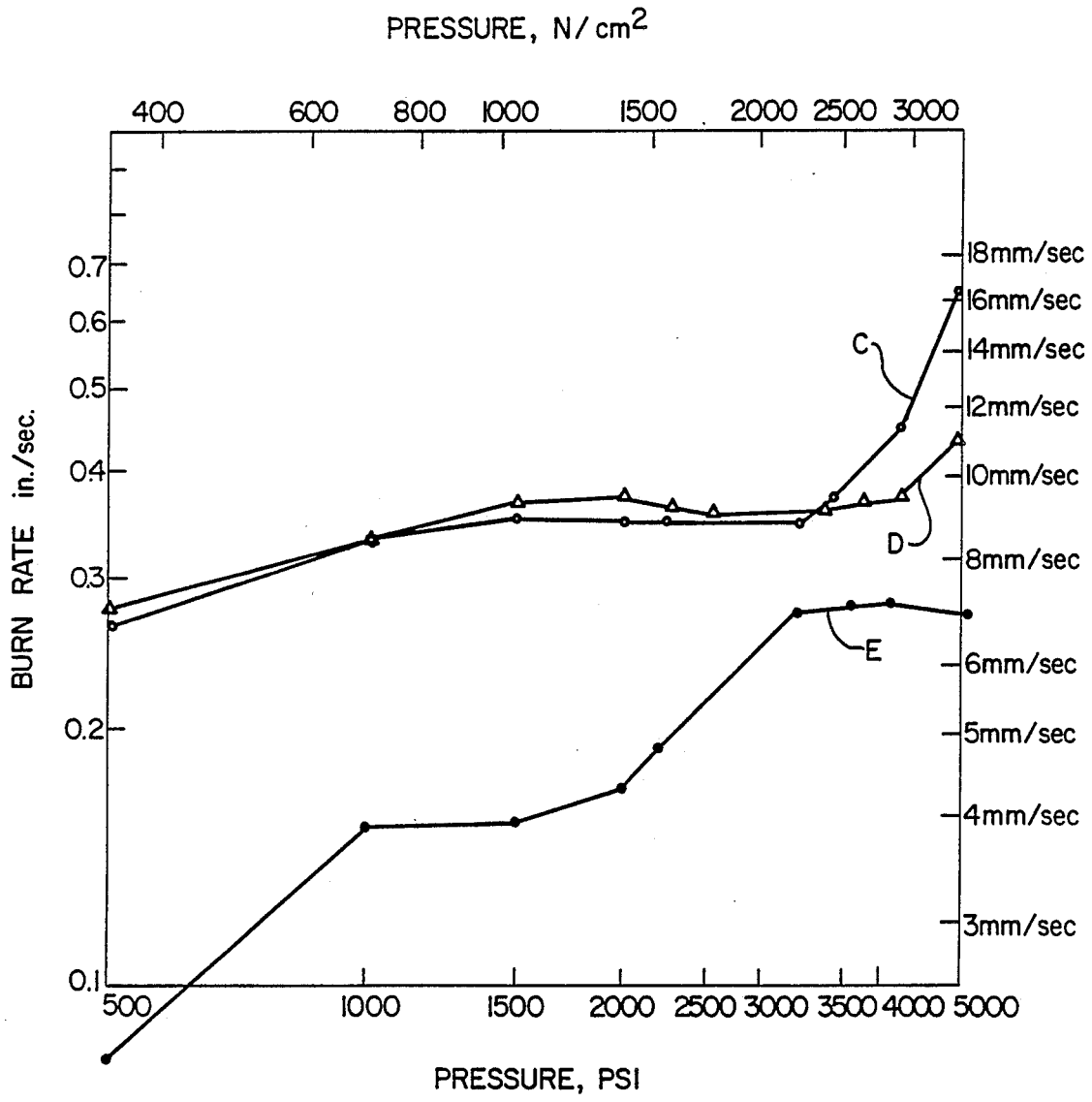
FIG. 2 shows the present invention and compares the ballistics of propellants containing ammonium sulfate and bound with hydroxy-terminated polybutadiene versus carboxy-terminated polybutadiene.

Turning to Table 1 and FIG. 2, compositions C and D were within the scope of the present invention, as they employed a carboxy-terminated polybutadiene binder, ammonium sulfate as a curing agent, and ammonium perchlorate as the oxidizer. Compositions C and D also contained a copper compound as a ballistic modifier. Plot C, for a composition employing copper chromite as a ballistic modifier, shows a substantially flat pressure exponent between about 1500 psi (1000 N/cm$^2$) and about 3200 psi (about 2200 N/cm$^2$). Curve C breaks sharply upward above this pressure region, but is very flat Within it. In the trial of plot D the propellant contained 0.5% copper phthalocyanine, and showed similar results between 1000 and about 3300 psi (about 1700 to 2200 N/cm$^2$), although the central region is not quite as flat as for curve C. However, curve D remains substantially flat, representing a substantially zero exponent, up to a pressure of about 4200 psi (nearly 3000 N/cm$^2$). Copper phthalocyanine thus provided a wider plateau of zero exponent behavior in the propellant, and thus a higher safe operating pressure. Propellant E differed from propellant D only in the use of a hydroxy-terminated polybutadiene binding agent instead of a carboxy-terminated polybutadiene binding agent. Curve E shows a clearly unsatisfactory propellant from the point of view of ballistics. The curve has a short plateau from about 1000 psi to 1500 psi (700 N/cm$^2$ to 1100 N/cm$^2$), and another plateau between about 3200 psi and 5000 psi (about 2200 to 4000 N/cm$^2$). The lower plateau is clearly at a pressure too low to provide a satisfactory gas generator, particularly one in which the combustion pressure is intended to be maximized. The high plateau is too high for a practical gas generator, since the case would have to withstand an extremely high pressure to operate in this range. FIG. 2 thus also establishes the criticality of other ingredients to the utility of copper phthalocyanine or copper chromite as ballistic modifiers when ammonium sulfate is present. The presence of ammonium sulfate was the primary distinction between the compositions of curve E of FIG. 2 and curve B of FIG. 1 (each being cured with DDI). Curves B and E will be noted to have a similar shape, although the shape is not as clearly apparent in FIG. 1.

Figure 3:
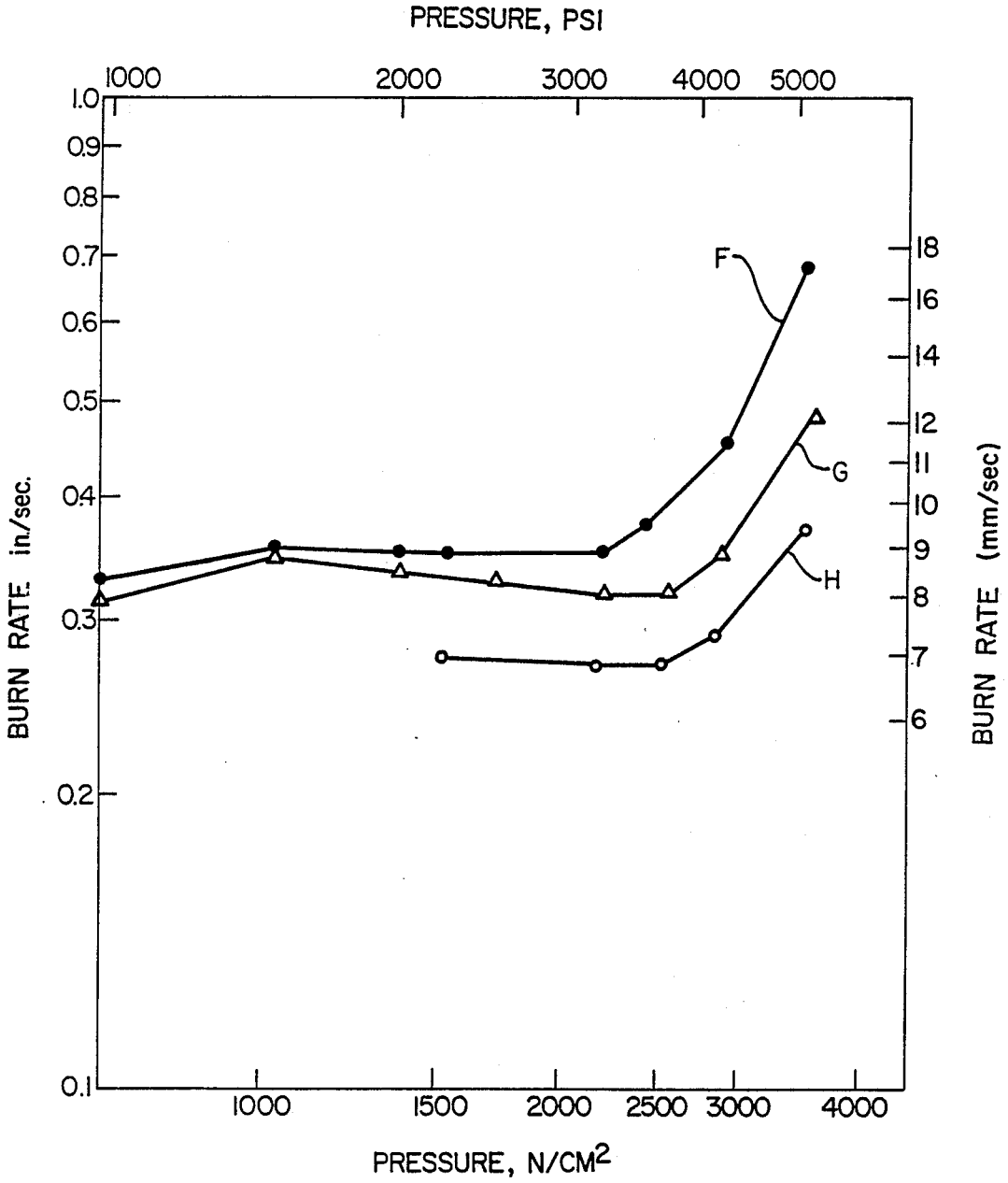
FIG. 3 shows the efficacy of three different copper compounds as ballistic modifiers.

FIG. 3 compares copper chromite, copper phthalocyanine, and copper stearate at identical 0.5% levels in a propellant which also contains 17% ammonium sulfate and a carboxy-terminated polybutadiene binder. Curve F employing copper chromite shows the highest burn rate, but has a flat pressure exponent plot only from 1500 to 3200 psi (about 1070 to 2200 N/cm$^2$). However, the pressure exponent is almost exactly zero in this range, before breaking upward above that pressure region. Curve G represents a propellant containing copper stearate and has a moderately negative exponent from 1500 to 3700 psi about 1070 to over 2500 N/om$^2$). While a zero exponent is preferred to a negative exponent, a negative exponent is preferred to a positive exponent because the burn rate of a negative exponent propellant will tend to moderate when pressure increases, thus counteracting the increase of burn rate. Curve H employs copper phthalocyanine, and in this particular formulation reduces burn rate somewhat, but provides a substantially zero pressure exponent from 2200 to 3700 psi (about 1500 to 2500N/cm$^2$), and probably below that range as well, although this data was not taken. Curve H breaks upward at about the same point as curve G, but its region of best pressure exponent is a substantially flat plateau instead of a negative exponent. Each of these curves represents a propellant with a theoretical flame temperature of 1855° F. (1013° C.), resulting from the incorporation in each of 17% ammonium sulfate. Curves F, G, and H all exhibit much better pressure exponent performance than curve E for most practical gas generators. FIG. 3 thus demonstrates that a variety of different copper compounds can provide the benefits of the present invention in an ammonium sulfate cooled carboxy-terminated polybutadiene bound propellant.

Figure 4:
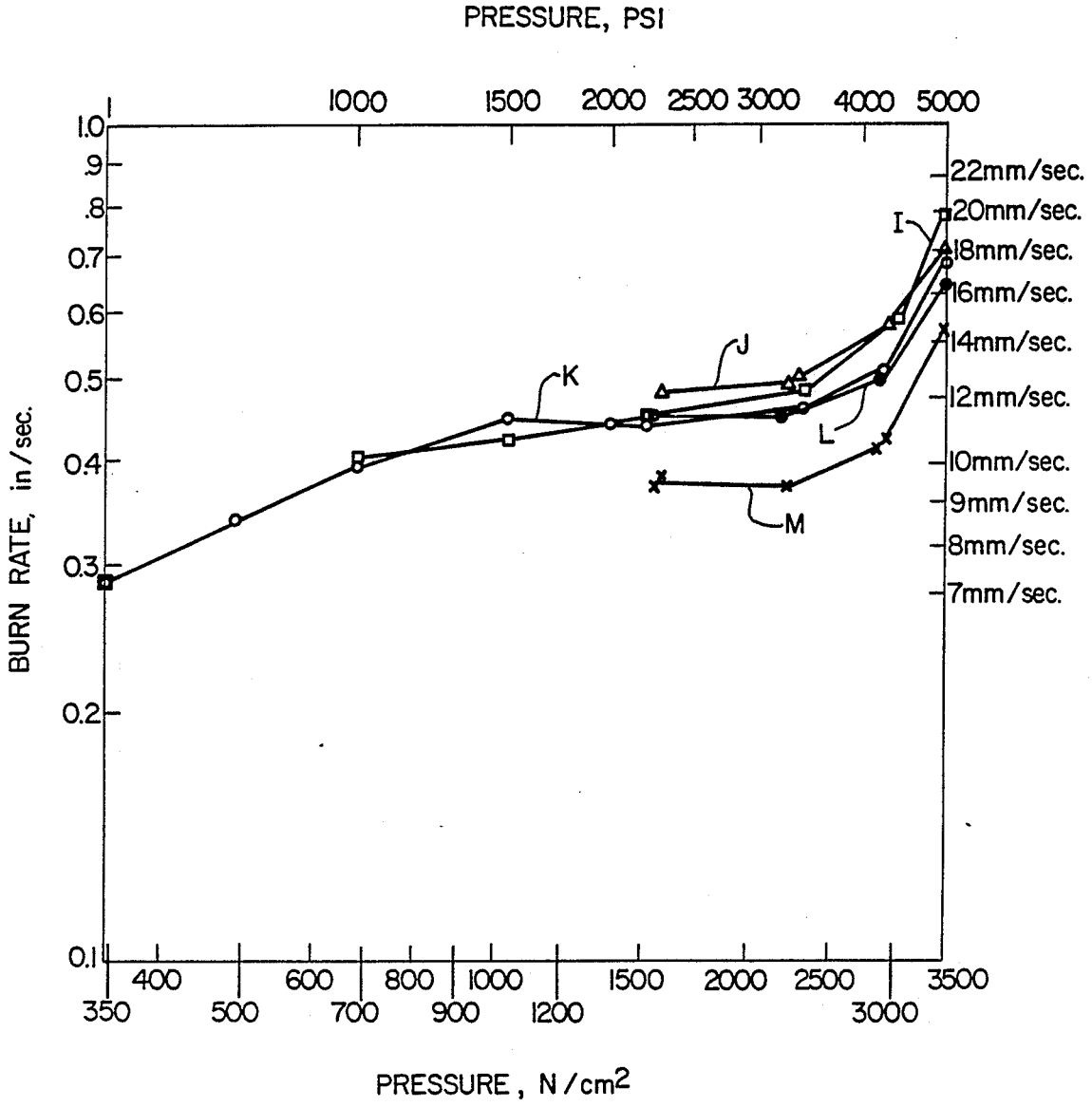
FIG. 4 shows the effect of the proportion of copper chromite in a propellant on its ballistic characteristics.

Turning to FIG. 4, these propellants contained a smaller quantity of ammonium sulfate and thus have a much higher burning rate. 0.1% copper chromite (Curve M) provided a flat pressure exponent between about 2300 and 3300 psi (about 1600 to 2250 N/cm$^2$). Burning rates and pressures were not measured below the lower end of the curve in this example. Thus, as little as 0.1% copper chromite provided at least some of the benefit of the invention. Curve I, for a propellant employing 0.3% copper chromite, does not show a region of flat pressure exponent, and so composition I was not a particularly desirable propellant The propellant characterized by Curve K contained 0.5% copper chromite. It provided a region of substantially zero pressure exponent between 1500 and about 3300 psi (about 1050 to 2350 N/cm$^2$). Its burning rate was also substantially better than that of composition M, which contained 0.1% copper chromite, and thus composition K was the most preferred of the M, I, and K compositions. Plot L has a similar shape to plot M, but at a higher burning rate. The same can be said of plot J, in which 1% copper chromite was employed in the propellant composition. Since curve I is a formulation having an intermediate amount of copper chromite, and is the only one which differs from the shape of the family of curves, it would appear that experimental error has affected plot I. All the other curves demonstrate the value of copper chromite as a ballistic modifier which produces a region of flat pressure exponent in a useful pressure range.

Figure 5:
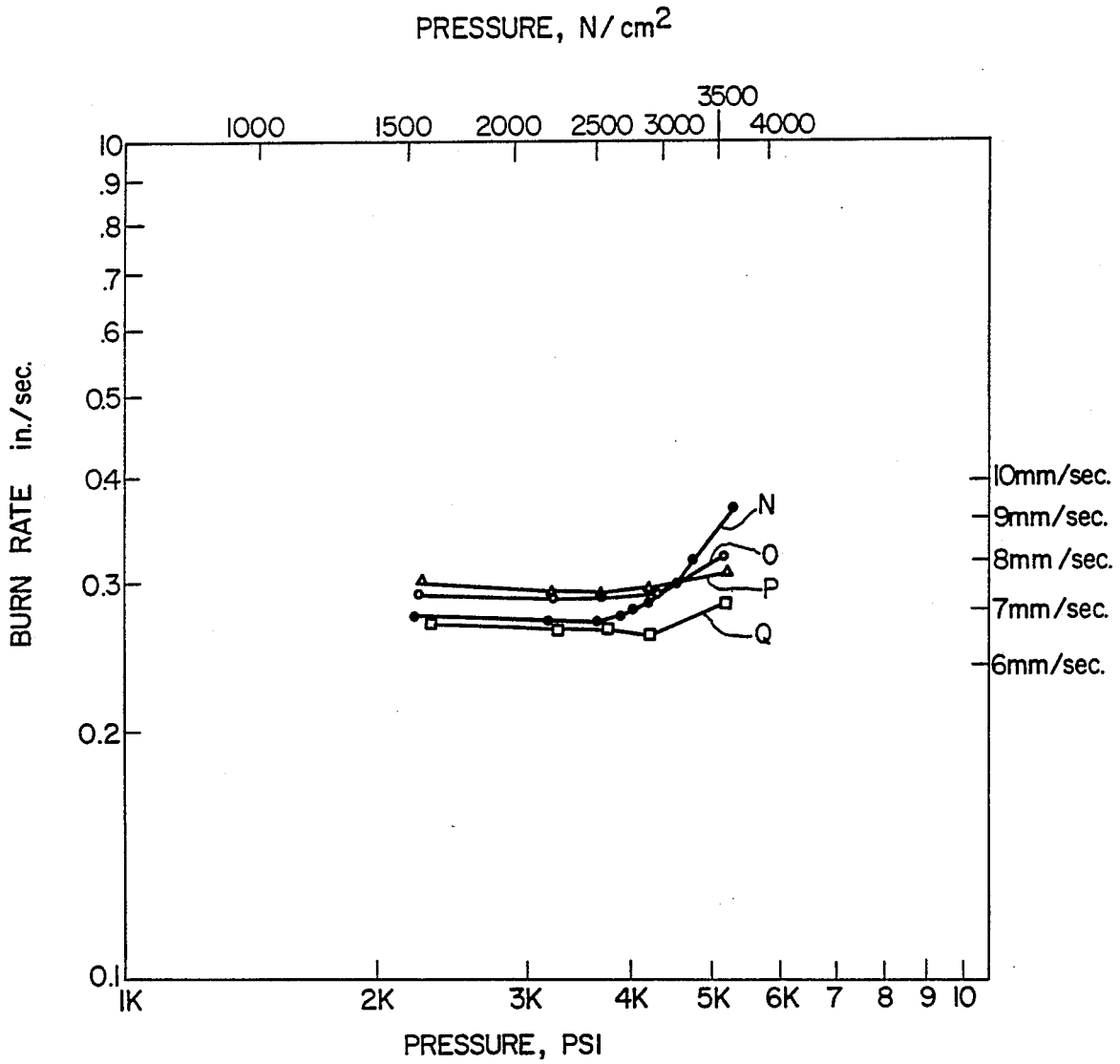
FIG. 5 shows the effect of different proportions of copper phthalocyanine in a propellant on its ballistics.

FIG. 5 shows the result of using various amounts of copper phthalocyanine in a propellant composition bound with carboxy-terminated polybutadiene and containing 17% ammonium sulfate as a cooling agent. While all the curves demonstrate a useful region of zero pressure exponent, curves O and P representing 1 to 1.5% copper phthalocyanine show a higher burning rate at lower pressures and a lower burning rate at higher pressures, and thus a very flat pressure exponent curve between about 2200 and 5000 psi (about 1500 to over 3500 N/cm$^2$) (particularly for plot P). Plot Q, representing 2% copper hthalocyanine, shows a flat pressure exponent region of nearly similar breadth, but at a lower burning rate. For that reason composition Q would usually be less desirable than composition P.

Figure 6:
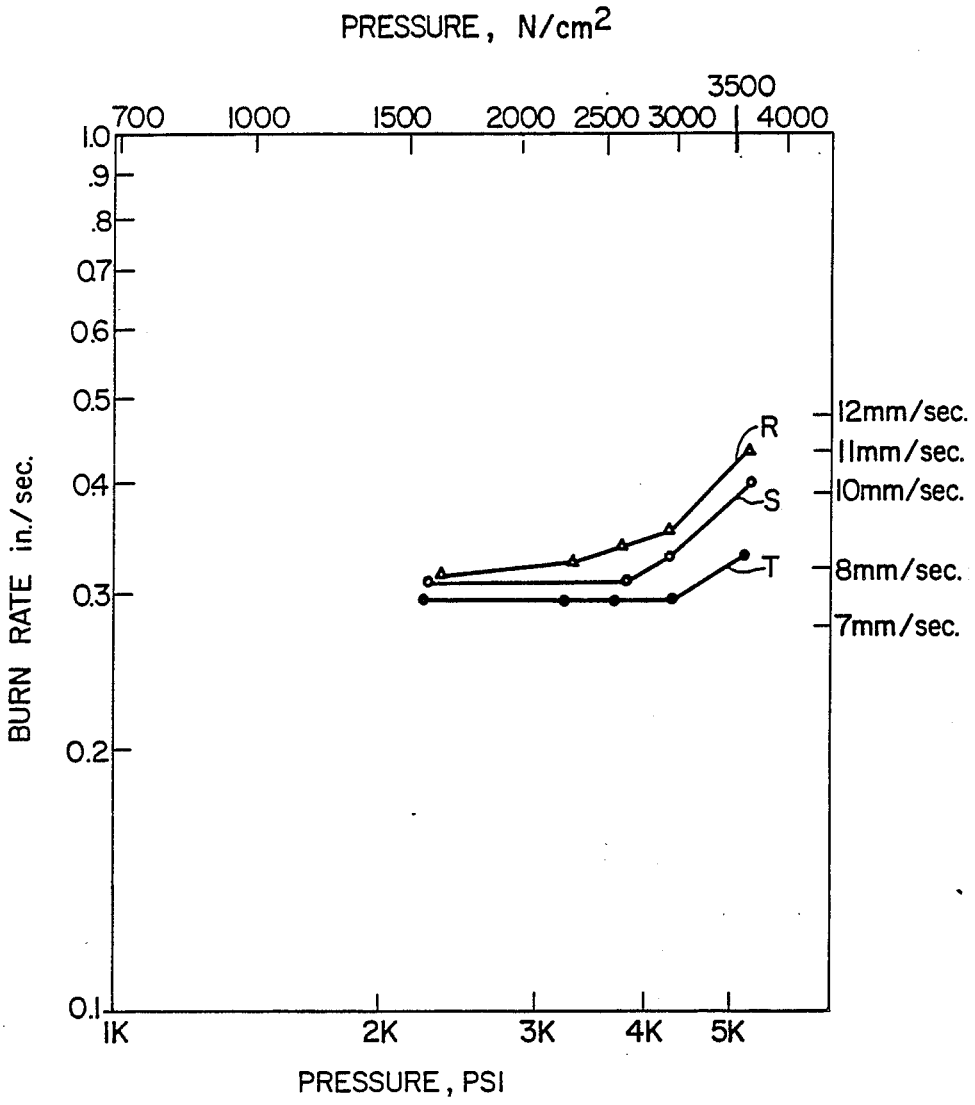
FIG. 6 shows the effect of different ammonium perchlorate particle size distributions on the ballistics of a propellant containing copper phthalocyanine.

In FIG. 6 the compositions have identical proportions chemically. However, as shown in Table 1, for composition R the ratio of 90 micron (weight mean diameter) ammonium perchlorate to 18 micron ammonium perchlorate was 50% to 50%, in composition S the ratio was 60% to 40%, and in composition T the ratio was 70% to 30%. Curve T provides the best result, thus illustrating the superiority of a 70/30 mixture of a 90 micron and 18 micron ammonium perchlorate in the present compositions. Plot T is substantially flat from about 2250 to 4300 psi (about 1500 to 3000 N/cm$^2$). Curve S provides a similarly low pressure exponent over a somewhat narrower range, providing a lower break point. Curve R does not show particularly good performance, as the entire curve is sloped substantially. All these curves are better than they Would be if a different ballistic modifier or no ballistic modifier was present.

Figure 7:
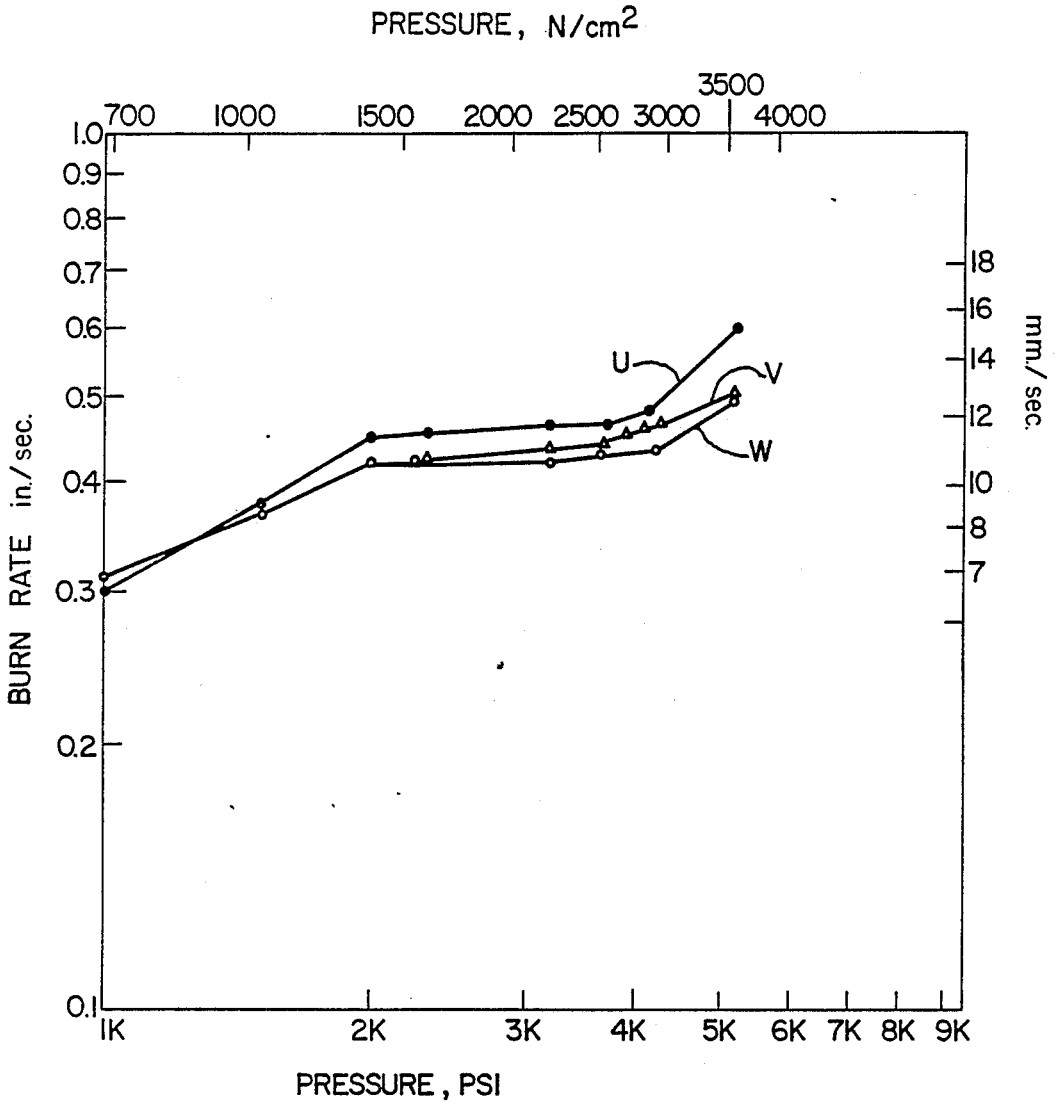
FIG. 7 shows the effect of additional cooling agents on the ballistic properties of the propellant.

FIG. 7 shows the results obtained from comparable formulations in which much of the ammonium sulfate was replaced with other cooling agents — DHG or DAG. These propellants also contained 0.5% ferric oxide as a burn rate catalyst. Only curve W represents a composition containing a copper compound as a ballistic modifier — copper phthalocyanine. First, the curves demonstrate some benefit of using the copper compound as a ballistic modifier, as curve W has a somewhat higher break point (about 4200 psi or 2900 N/cm$^2$) defining the end of its region of substantially zero pressure exponent. The break point of curve V is at about 3700 psi (about 2500 N/cm$^2$), and the break point of curve U appears to be at about the same point. In fact. curve V slopes positively over its entire length. FIG. 7 also demonstrates that when less ammonium sulfate is used as a cooling agent (as noted from Table 1 for compositions U, V, and W), copper phthalocyanine seems to have a less pronounced effect on the ballistics of the compositions. (Compare curves and compositions V and W.)

Table 2 shows the compositions and $\pi_k$ values for propellant compositions X - AC. To obtain $\pi_k$ values, a series of 1 lb. (.45 kg) end-burner motors were made and fired at two different initial propellant temperatures (obtained by conditioning the unburned motor at the desired propellant temperature for long enough to reach equilibrium at that temperature). Here, $T_2$ was 125° F. (52° C.) and $T_1$ was −15° F. (−26° C.). The pressures given in the table are the actual P values at which $\pi_k$ was measured. First comparing compositions X and Y containing different proportions of copper phthalocyanine, at lower pressures a greater proportion of copper phthalocyanine provided a higher $\pi_k$, which is less desirable. At a pressure which exceeded 3000 psi (2000 N/cm$^2$), however, the higher amount of copper phthalocyanine provided a lower $\pi_k$. To put this in perspective, no low flame temperature gas generator composite propellant has previously been developed with a $\pi_k$ value of less than 0.2% per °F. (0.36% per °C.) for a pressure greater than 3000 psi (about 2000 N/cm$^2$). Thus, both formulation X and formulation Y exhibit the desirable $\pi_k$ benefit of the present invention.

Now compare trials X and Z, which differ only in that ferric oxide was added to Z. Only the medium and high pressure $\pi_k$ values were measured. The composition containing ferric oxide performed somewhat better than the composition without ferric oxide, even though the actual pressures of measurement of $\pi_k$ for formula Z were slightly higher. Formulation Z thus appears to be even better than formulas X or Y, although all three are among the best ever reported.

Trials AA and AC are respectively formulations which lack or contain 0.5% copper phthalocyanine and otherwise are substantially identical. The medium pressure measurement of $\pi_k$ for compositions AA and AC shows that the presence of copper phthalocyanine lowers the $\pi_k$ value substantially, providing a value of 0.136% per °F. (0.24% per ° C). For the high pressure $\pi_k$, even more dramatic results are achieved. Composition AA burst the test motor, and thus $\pi_k$ was not measurable. Composition AC had a very low $\pi_k$ value of 0.1% per °F. (0.18% per °C.). Thus, without the copper compound the propellant failed, and with the copper compound it provided exceedingly good performance. Comparing compositions AA and AB, which were the same except for the choice of different cooling agents, composition AB had a substantially higher $\pi_k$ at moderate pressure than did composition AC.

Table 3 shows a formulation within the scope of the present invention and Table 4 shows the mechanical properties of the composition of Table 3. The properties changed substantially at first as curing continued, but became substantially consistent after several weeks. These properties are satisfactory for use of the present compositions in gas generators.

TABLE 1

| Plot: | A[15] | B[15] | C | D | E | F | G | H | I | J | K | L | M |
|---|---|---|---|---|---|---|---|---|---|---|---|---|---|
| Ingredient (wt. %) | Prior Art | Prior Art | | | | | | | | | | | |
| Ammonium perchlorate[1] | | | 57.50 | 57.50 | 57.50 | 57.50 | 57.50 | 57.50 | 66.70 | 66.00 | 66.50 | 66.30 | 66.90 |
| HTPB[2] | x | x | — | — | 20.62 | — | — | — | — | — | — | — | — |
| IPDI[14] | x | — | — | — | — | — | — | — | — | — | — | — | — |
| DDI[3] | | x | — | — | 4.08 | — | — | — | — | — | — | — | — |
| HX-752[4] | | | — | — | 0.30 | — | — | — | — | — | — | — | — |
| CTPB[5] | | | 23.94 | 23.94 | — | 23.94 | 23.94 | 23.94 | 23.94 | 23.94 | 23.94 | 23.94 | 23.94 |
| ERL-0510[6] | | | 1.05 | 1.05 | — | 1.05 | 1.05 | 1.05 | 1.05 | 1.05 | 1.05 | 1.05 | 1.05 |
| Chromium octate | | | 0.01 | 0.01 | — | 0.01 | 0.01 | 0.01 | 0.01 | 0.01 | 0.01 | 0.01 | 0.01 |
| Ammonium sulfate | | | 17.00 | 17.00 | 17.00 | 17.00 | 17.00 | 17.00 | 8.00 | 8.00 | 8.00 | 8.00 | 8.00 |
| DHG[7] | | | — | — | — | — | — | — | — | — | — | — | — |
| DAG[8] | | | — | — | — | — | — | — | — | — | — | — | — |
| Copper phthalocyanine | 0.5 | 0.5 | — | 0.50 | 0.50 | — | — | 0.50 | — | — | — | — | — |
| Copper | | | 0.50 | — | — | 0.50 | — | — | 0.30 | 1.00 | 0.50 | 0.70 | 0.10 |

TABLE 1-continued

| | | | | | | | | | | | | | |
|---|---|---|---|---|---|---|---|---|---|---|---|---|---|
| chromite[9] | | | | | | | | | | | | | |
| Copper stearate | | | — | — | — | — | 0.50 | — | — | — | — | — | — |
| Ferric oxide | | | | | | | | | | | | | |
| Total | 100.00 | 100.00 | 100.00 | 100.00 | 100.00 | 100.00 | 100.00 | 100.00 | 100.00 | 100.00 | 100.00 | 100.00 | 100.00 |
| | Plot: | | N | O | P | Q | R | S | T | U | V | W | |
| | Ingredient (wt. %) | | | | | | | | | | | | |
| | Ammonium perchlorate[1] | | 57.50 | 57.00 | 56.50 | 56.00 | 57.00 (50/50)[10] | 57.00 (60/40)[11] | 57.00 (70/30)[12] | 49.50 | 49.50 | 49.00 | |
| | HTPB[2] | | — | — | — | — | — | — | — | — | — | — | |
| | IPDI[14] | | — | — | — | — | — | — | — | — | — | — | |
| | DDI[3] | | — | — | — | — | — | — | — | — | — | — | |
| | HX-752[4] | | — | — | — | — | — | — | — | — | — | — | |
| | CTPB[5] | | 23.94 | 23.94 | 23.94 | 23.94 | 23.94 | 23.94 | 23.94 | 23.94 | 23.94 | 23.94 | |
| | ERL-0510[6] | | 1.05 | 1.05 | 1.05 | 1.05 | 1.05 | 1.05 | 1.05 | 1.05 | 1.05 | 1.05 | |
| | Chromium octoate | | 0.01 | 0.01 | 0.01 | 0.01 | 0.01 | 0.01 | 0.01 | 0.01 | 0.01 | 0.01 | |
| | Ammonium sulfate | | 17.00 | 17.00 | 17.00 | 17.00 | 17.00 | 17.00 | 17.00 | 5.00 | 5.00 | 5.0 | |
| | DHG[7] | | — | — | — | — | — | — | — | 0 | 20 | 20 | |
| | DAG[8] | | — | — | — | — | — | — | — | 20 | 0 | 0 | |
| | Copper phthalocyanine | | 0.50 | 1.00 | 1.50 | 2.00 | 1.00 | 1.00 | 1.00 | — | — | 0.50 | |
| | Copper chromite[9] | | — | — | — | — | — | — | — | — | — | — | |
| | Copper stearate | | — | — | — | — | — | — | — | — | — | — | |
| | Ferric oxide | | | | | | — | — | — | 0.50 | 0.50 | 0.50 | |
| | Total | | 100.00 | 100.00 | 100.00 | 100.00 | 100.00 | 100.00 | 100.00 | 100.00 | 100.00 | 100.00 | |

Note: Footnotes are in the last table.

TABLE 2

| Example: | X | Y | Z | AA | AB | AC |
|---|---|---|---|---|---|---|
| Ingredient (wt. %) | | | | | | |
| Ammonium perchlorate[1] | 57.50 | 57.00 | 57.00 | 57.50 | 57.50 | 57.00 |
| CTPB[5] | 23.94 | 23.94 | 23.94 | 23.94 | 23.94 | 23.94 |
| ERL-0510[6] | 1.05 | 1.05 | 1.05 | 1.05 | 1.05 | 1.50 |
| Chromium octate | 0.01 | 0.01 | 0.01 | 0.01 | 0.01 | 0.01 |
| Ammonium sulfate | 17.00 | 17.00 | 17.00 | 5.00 | 5.00 | 5.00 |
| DHG[7] | — | — | — | 20.00 | — | 20.00 |
| DAG[8] | — | — | — | — | 20.00 | — |
| Copper phthalocyanine | 0.50 | 1.00 | 0.50 | — | — | 0.50 |
| Ferric oxide | — | — | 0.5 | 0.5 | 0.5 | 0.5 |
| Total | 100.00 | 100.00 | 100.00 | 100.00 | 100.00 | 100.00 |
| $\eta_k$, %/°C. | 0.27 | 0.76 | — | — | — | 0.32 |
| pressure, N/cm$^2$ | 1614 | 1577 | — | — | — | 1704 |
| $\eta_k$, %/°C. | 0.32 | 0.41 | 0.26 | 0.31 | 0.51 | 0.24 |
| pressure, N/cm$^2$ | 1828 | 1870 | 1966 | 1833 | 1869 | 1992 |
| $\eta_k$, %/°C. | 0.36 | 0.28 | 0.28 | Burst[13] | Burst[13] | 0.18 |
| pressure, N/cm$^2$ | 2070 | 2164 | 2359 | — | — | 2234 |

Note: Footnotes are in the last table.

TABLE 3

| Example: | AD |
|---|---|
| Ingredient (wt. %) | |
| Ammonium perchlorate[1] | 57.50 |
| CTPB[5] | 23.94 |
| ERL-0510[6] | 1.05 |
| Chromium octoate | 0.01 |
| Ammonium sulfate | 17.00 |
| Copper phthalocyanine | 0.50 |

TABLE 3-continued

| Example: | AD |
|---|---|
| Total | 100.00 |

Note: Footnotes are in the last table.

TABLE 4

| Time at 66° C. (weeks) | Modulus $E_0$ N/cm$^2$ | Stress (cm) N/cm$^2$ | Strain, % $Em/E_R$ |
|---|---|---|---|
| 0 | 647 | 123 | 48/50 |
| 2 | 949 | 136 | 24/32 |
| 4 | 982 | 142 | 25/30 |
| 6 | 1110 | 151 | 24/28 |
| 8 | 1240 | 155 | 16/18 |

TABLE 4-continued

| Time at 66° C. (weeks) | Modulus $E_0$ N/cm$^2$ | Stress (cm) N/cm$^2$ | Strain, % Em/$E_R$ |
|---|---|---|---|
| 10 | 1360 | 140 | 20/22 |

Footnotes to Tables 1. 70 wt. % 90 micron particles, 30 wt. % 18 micron particles (unless otherwise specified).

2. hydroxy-terminated polybutadiene; sold under the trade designation R45M by Arco Chemical Co., Philadelphia, Pa.

3. Tradename for a proprietary aliphatic diisocyanate sold by Henkel Corp., Minneapolis, Minn.

4. propylene imine adduct of isophthalyl chloride; acts as a bonding agent.

5. carboxy-terminated polybutadiene, equivalent weight 1923 grams; sold under the tradename HC-434 by Thiokol Corp., Ogden, Utah.

6. triglycidyl ether adduct of p-aminophenol equivalent weight 97 grams.

dihydroxyglyoxime 8. diaminoglyoxime

9. $CuO:Cr_2O_3$ ratio is 17%:83% (unless otherwise specified).

10. indicates a mixture of 50% 90micron weight mean diameter ammonium perchlorate and 50% 18 micron weight mean diameter ammonium perchlorate.

11. similar to 10, with 60% 90 micron ammonium perchlorate and 40% 18 micron ammonium perchlorate 12. similar to 11, with 70/30 ratio.

13. case burst due to overpressure during combustion.

14. isophorone diisocyanate.

15. ingredients marked "x" are those identified by prior art. Their proportions are not known except as indicated, and other ingredients were probably present.

I claim:

1. A composite propellant composition consisting essentially of:

A. from about 20 to about 88 percent by weight ammonium perchlorate;

B. from about 8 to about 40 percent by weight of a carboxy-terminated polybutadiene binder;

C. from about 3 to about 20 percent by weight ammonium sulfate; and

D. from about 0.1 to about 2 percent by weight of at least one copper compound.

2. The composition of claim 1, wherein said at least one copper compound is a copper salt of a carboxylic acid.

3. The composition of claim 1, wherein said at least one copper compound is copper stearate.

4. The composition of claim 1, wherein said at least one copper compound is from about 0.5 to about 2 percent by weight copper stearate.

5. The composition of claim 1, wherein said at least one copper compound is a copper chelate.

6. The composition of claim 1, wherein said at least one copper compound is copper phthalocyanine.

7. The composition of claim 1, wherein said at least one copper compound is from about 0.5 to about 2 percent by weight copper phthalocyanine.

8. The composition of claim 1, wherein said at least one copper compound is from about 1 to about 1.5 percent by weight copper phthalocyanine.

9. The composition of claim 1, wherein said at least one copper compound is an inorganic copper salt.

10. The composition of claim 1, wherein said at least one copper compound is copper chromite.

11. The composition of claim 1, wherein said at least one copper compound is from about 0.5 to about 0 7 percent by weight copper chromite.

12. The composition of claim 1, consisting essentially of from about 0 5 to about 2 percent by weight of said at least one copper compound.

13. The composition of claim 1, further consisting essentially of from about 1 to about 20 percent by weight of a metal powder selected from the group consisting of aluminum, magnesium, boron, zinc, and mixtures thereof.

14. The composition of claim 1, which is essentially free of lead compounds.

15. The composition of claim 1, consisting essentially of:

A. from about 50 to about 70 percent by weight ammonium perchlorate;

B. from about 15 to about 30 percent by weight of a carboxy-terminated polybutadiene binder;

C. from about 8 to about 17 percent by weight ammonium sulfate; and

D. from about 0.5 to 1.5 percent by weight copper phthalocyanine.

16. A composite propellant composition consisting essentially of:

A. ammonium perchlorate;

B. at least a sufficient proportion of a carboxy-terminated polybutadiene binder to disperse the other ingredients of said propellant;

C. a sufficient proportion of ammonium sulfate to reduce the flame temperature of said composition to less than about 1100° C.; and D. a sufficient proportion of at least one copper compound to reduce the $\pi_k$ and pressure exponent of said propellant.

17. The composition of claim 16, having a $\pi_k$ value at a pressure of about 2068 N/cm$^2$ of less than or equal to about 0.30 percent per degree Celsius and a pressure exponent of substantially zero at a combustion chamber pressure of from about 1375 to about 2400 N/cm$^2$.

18. The composition of claim 17, having a burning rate which is not substantially reduced by the addition of said copper compound.

* * * * *

UNITED STATES PATENT AND TRADEMARK OFFICE

CERTIFICATE OF CORRECTION

PATENT NO. : 4,971,640

DATED : November 20, 1990

INVENTOR(S) : Minn-Shong Chi

It is certified that error appears in the above-identified patent and that said Letters Patent is hereby corrected as shown below:

Table 1,

Table 1, cols. 9-12, Table 1 should appear as shown in the attached copy of Table 1

Table 2, col. 11, lines 16-17 of table, "Ferric" should be -- Ferric oxide -- and the line consisting of the word "oxide" should be deleted.

Table 3, lines 12 and 13 of table, original "copper phthalocyanine" should be shown as a single ingredient and the ruling below "0.50" should be lower than "phthalocyanine".

Table 4, column 12, line 63, In the heading of the third column, "cm" should be -- σm --.

Signed and Sealed this

Fourth Day of August, 1992

*Attest:*

DOUGLAS B. COMER

*Attesting Officer*

*Acting Commissioner of Patents and Trademarks*

UNITED STATES PATENT AND TRADEMARK OFFICE

CERTIFICATE OF CORRECTION

PATENT NO. : 4,971,640

DATED : November 20, 1990

INVENTOR(S) : Minn-Shong Chi

It is certified that error appears in the above-identified patent and that said Letters Patent is hereby corrected as shown below:

Please correct Table 1 as follows:

Table 1

| Plot: | A[1,4] | B[1,4] | C | D | E |
|---|---|---|---|---|---|
| | Prior Art | Prior Art | | | |
| Ingredient (wt.%) | | | | | |
| Ammonium perchlorate[1] | | | 57.50 | 57.50 | 57.50 |
| HTPB[2] | x | x | -- | -- | 20.62 |
| IPDI[1,4] | x | -- | -- | -- | -- |
| DDI[3] | | x | -- | -- | 4.08 |
| HX-752[4] | | | -- | -- | 0.30 |
| CTPB[5] | | | 23.94 | 23.94 | -- |
| ERL-0510[6] | | | 1.05 | 1.05 | -- |
| Chromium octoate | | | 0.01 | 0.01 | -- |
| Ammonium sulfate | | | 17.00 | 17.00 | 17.00 |
| DHG[7] | | | -- | -- | -- |
| DAG[8] | | | -- | -- | -- |
| Copper phthalocyanine | 0.5 | 0.5 | -- | 0.50 | 0.50 |
| Copper chromite[9] | | | 0.50 | -- | -- |
| Copper stearate | | | -- | -- | -- |
| Total | 100.00 | 100.00 | 100.00 | 100.00 | 100.00 |

Note: Footnotes are in the last table.

UNITED STATES PATENT AND TRADEMARK OFFICE

CERTIFICATE OF CORRECTION

PATENT NO. : 4,971,640

DATED : November 20, 1990

INVENTOR(S) : Minn-Shong Chi

It is certified that error appears in the above-identified patent and that said Letters Patent is hereby corrected as shown below:

Table 1 (continued)

| Plot: | F | G | H |
|---|---|---|---|
| Ingredient (wt.%) | | | |
| Ammonium perchlorate[1] | 57.50 | 57.50 | 57.50 |
| HTPB[2] | -- | -- | -- |
| IPDI[1a] | -- | -- | -- |
| DDI[3] | -- | -- | -- |
| HX-752[4] | -- | -- | -- |
| CTPB[5] | 23.94 | 23.94 | 23.94 |
| ERL-0510[6] | 1.05 | 1.05 | 1.05 |
| Chromium octoate | 0.01 | 0.01 | 0.01 |
| Ammonium sulfate | 17.00 | 17.00 | 17.00 |
| DHG[7] | -- | -- | -- |
| DAG[8] | -- | -- | -- |
| Copper phthalocyanine | -- | -- | 0.50 |
| Copper chromite[9] | 0.50 | -- | -- |
| Copper stearate | -- | 0.50 | -- |
| Total | 100.00 | 100.00 | 100.00 |

Note: Footnotes are in the last table.

UNITED STATES PATENT AND TRADEMARK OFFICE

CERTIFICATE OF CORRECTION

PATENT NO. : 4,971,640

DATED : November 20, 1990

INVENTOR(S) : Minn-Shong Chi

It is certified that error appears in the above-identified patent and that said Letters Patent is hereby corrected as shown below:

Table 1 (continued)

| Plot: | I | J | K | L | M |
|---|---|---|---|---|---|
| Ingredient (wt.%) | | | | | |
| Ammonium perchlorate[1] | 66.70 | 66.00 | 66.50 | 66.30 | 66.90 |
| HTPB[2] | -- | -- | -- | -- | -- |
| IPDI[1,4] | -- | -- | -- | -- | -- |
| DDI[3] | -- | -- | -- | -- | -- |
| HX-752[4] | -- | -- | -- | -- | -- |
| CTPB[5] | 23.94 | 23.94 | 23.94 | 23.94 | 23.94 |
| ERL-0510[6] | 1.05 | 1.05 | 1.05 | 1.05 | 1.05 |
| Chromium octoate | 0.01 | 0.01 | 0.01 | 0.01 | 0.01 |
| Ammonium sulfate | 8.00 | 8.00 | 8.00 | 8.00 | 8.00 |
| DHG[7] | -- | -- | -- | -- | -- |
| DAG[8] | -- | -- | -- | -- | -- |
| Copper phthalocyanine | -- | -- | -- | -- | -- |
| Copper chromite[9] | 0.30 | 1.00 | 0.50 | 0.70 | 0.10 |
| Copper stearate | -- | -- | -- | -- | -- |
| Total | 100.00 | 100.00 | 100.00 | 100.00 | 100.00 |

Note: Footnotes are in the last table.

UNITED STATES PATENT AND TRADEMARK OFFICE

CERTIFICATE OF CORRECTION

PATENT NO. : 4,971,640

DATED : November 20, 1990

INVENTOR(S) : Minn-Shong Chi

It is certified that error appears in the above-identified patent and that said Letters Patent is hereby corrected as shown below:

Table 1 (continued)

| Plot: | N | O | P | Q |
|---|---|---|---|---|
| Ingredient (wt.%) | | | | |
| Ammonium perchlorate[1] | 57.50 | 57.00 | 56.50 | 56.00 |
| HTPB[2] | -- | -- | -- | -- |
| IPDI[1a] | -- | -- | -- | -- |
| DDI[3] | -- | -- | -- | -- |
| HX-752[4] | -- | -- | -- | -- |
| CTPB[5] | 23.94 | 23.94 | 23.94 | 23.94 |
| ERL-0510[6] | 1.05 | 1.05 | 1.05 | 1.05 |
| Chromium octoate | 0.01 | 0.01 | 0.01 | 0.01 |
| Ammonium sulfate | 17.00 | 17.00 | 17.00 | 17.00 |
| DHG[7] | -- | -- | -- | -- |
| DAG[8] | -- | -- | -- | -- |
| Copper phthalocyanine | 0.50 | 1.00 | 1.50 | 2.00 |
| Copper chromite[9] | -- | -- | -- | -- |
| Copper stearate | -- | -- | -- | -- |
| Total | 100.00 | 100.00 | 100.00 | 100.00 |

Note: Footnotes are in the last table.

PRINTER'S TRIM LINE

UNITED STATES PATENT AND TRADEMARK OFFICE

CERTIFICATE OF CORRECTION

PATENT NO. : 4,971,640

DATED : November 20, 1990

INVENTOR(S) : Minn-Shong Chi

It is certified that error appears in the above-identified patent and that said Letters Patent is hereby corrected as shown below:

Table 1 (continued)

| Plot: | R | S | T | U | V | W |
|---|---|---|---|---|---|---|
| Ingredient (wt.%) | | | | | | |
| Ammonium perchlorate[1] | 57.00 (50/50)[10] | 57.00 (60/40)[11] | 57.00 (70/30)[12] | 49.50 | 49.50 | 49.00 |
| HTPB[2] | -- | -- | -- | -- | -- | -- |
| IPDI[14] | -- | -- | -- | -- | -- | -- |
| DDI[3] | -- | -- | -- | -- | -- | -- |
| HX-752[4] | -- | -- | -- | -- | -- | -- |
| CTPB[5] | 23.94 | 23.94 | 23.94 | 23.94 | 23.94 | 23.94 |
| ERL-0510[6] | 1.05 | 1.05 | 1.05 | 1.05 | 1.05 | 1.05 |
| Chromium octoate | 0.01 | 0.01 | 0.01 | 0.01 | 0.01 | 0.01 |
| Ammonium sulfate | 17.00 | 17.00 | 17.00 | 5.00 | 5.00 | 5.00 |
| DHG[7] | -- | -- | -- | 0 | 20 | 20 |
| DAG[8] | -- | -- | -- | 20 | 0 | 0 |
| Copper phthalocyanine | 1.00 | 1.00 | 1.00 | -- | -- | 0.50 |
| Copper chromite[9] | -- | -- | -- | -- | -- | -- |
| Copper stearate | -- | -- | -- | -- | -- | -- |
| Ferric oxide | -- | -- | -- | 0.50 | 0.50 | 0.50 |
| Total | 100.00 | 100.00 | 100.00 | 100.00 | 100.00 | 100.00 |

Note: Footnotes are in the last table.

UNITED STATES PATENT AND TRADEMARK OFFICE

CERTIFICATE OF CORRECTION

PATENT NO. : 4,971,640

DATED : November 20, 1990

INVENTOR(S) : Minn-Shong Chi

It is certified that error appears in the above-identified patent and that said Letters Patent is hereby corrected as shown below:

In column 2, line 48, specification page 4, line 4, "Which" should be -- which --.

In column 3, line 53, specification page 6, line 11, after the word "properties" insert -- . --.

In column 4, line 6, specification page 6, line 31, "cf" should be -- of --.

In column 4, line 33, specification page 7, line 25, "lo" should be -- to --.

In column 4, line 54, specification page 8, line 11, "desirabIe" should be -- desirable --.

In column 5, line 50, specification page 9, line 36, "polyoarboxylic" should be -- polycarboxylic --.

In column 5, line 53, specification page 10, line 2, after the word "herein" insert -- . --.

In column 6, line 65, specification page 12, line 7, "Teohnology" should be -- Technology --.

In column 8, line 5, specification page 14, line 8, before the word "about" insert -- ( --.

In column 8, line 5, specification page 14, line 8, "$N/om^2$" should be -- $N/cm^2$ --.

UNITED STATES PATENT AND TRADEMARK OFFICE

CERTIFICATE OF CORRECTION

PATENT NO. : 4,971,640

DATED : November 20, 1990

INVENTOR(S) : Minn-Shong Chi

It is certified that error appears in the above-identified patent and that said Letters Patent is hereby corrected as shown below:

In column 8, line 40, specification page 15, line 4, after the word "propellant" insert -- . --.

In column 9, line 2, specification page 15, line 32, "hthalocyanine" should be -- phthalocyanine --.

In column 9, line 21, specification page 16, line 14, "Would" should be -- would --.

In column 9, line 37, specification page 16, line 29, after the word "fact" insert -- , --.

In column 13, line 24, specification page 26, line 15, before the word "dihydroxyglyoxime" insert -- 7. --.

In column 13, line 28, specification page 26, line 18, "90micron" should be -- 90 micron --.

Patent claim 11, line 23, original application claim 11, line 2, "0 7" should be -- 0.7 --.

Patent claim 12, line 2, original application claim 12, line 2, "0 5" should be -- 0.5 --.

Patent Table 1, pages 19-23, original application Table 1, cols. 9-12, Table 1 should appear as shown in the attached copy of Table 1 in the specification.